US006190530B1

(12) United States Patent
Brodsky et al.

(10) Patent No.: US 6,190,530 B1
(45) Date of Patent: Feb. 20, 2001

(54) ANODE CONTAINER, ELECTROPLATING SYSTEM, METHOD AND PLATED OBJECT

(75) Inventors: William Louis Brodsky, Binghamton; Donald W. Henderson, Ithaca; Lawrence Philip Lehman, Endicott, all of NY (US)

(73) Assignee: International Business Machines Corporation, Armonk, NY (US)

( * ) Notice: Under 35 U.S.C. 154(b), the term of this patent shall be extended for 0 days.

(21) Appl. No.: 09/291,135

(22) Filed: Apr. 12, 1999

(51) Int. Cl.[7] ..... C25D 5/00

(52) U.S. Cl. ..... 205/147; 205/96; 205/148; 204/259; 204/261; 204/273; 204/280; 204/284; 204/287; 204/224 R

(58) Field of Search ..... 204/259, 261, 204/273, 280, 284, 287, 224 R; 205/147, 148, 96

(56) References Cited

U.S. PATENT DOCUMENTS

| | | | | |
|---|---|---|---|---|
| 2,559,926 | | 7/1951 | Beebe | 204/287 |
| 3,300,396 | * | 1/1967 | Walker | 204/287 |
| 3,862,745 | | 1/1975 | Chiz | 204/287 |
| 4,039,403 | | 8/1977 | Astley et al. | 204/287 |
| 4,059,493 | | 11/1977 | Rice | 204/287 |
| 4,077,864 | * | 3/1978 | Vanderveer et al. | 204/287 |
| 4,197,181 | * | 4/1980 | Portal et al. | 204/287 |
| 4,342,635 | * | 8/1982 | Becker et al. | 204/287 |
| 4,569,744 | | 2/1986 | Walker | 204/284 |
| 5,340,456 | | 8/1994 | Mehler | 204/287 |
| 5,597,460 | * | 1/1997 | Reynolds | 204/287 |
| 5,620,586 | * | 4/1997 | Claessens et al. | 204/259 |
| 5,744,013 | * | 4/1998 | Botts et al. | 204/287 |
| 5,766,430 | * | 6/1998 | Mehler | 204/259 |
| 5,776,327 | * | 7/1998 | Botts et al. | 204/227 |
| 5,938,899 | * | 8/1999 | Forand | 204/259 |

FOREIGN PATENT DOCUMENTS 315481 7/1929 (GB) .

* cited by examiner

*Primary Examiner*—Bruce F. Bell
(74) *Attorney, Agent, or Firm*—Schmeiser, Olsen & Watts; Lawrence R. Fraley

(57) ABSTRACT

An anode container, electroplating system, method and object so plated. A feature of the invention is that an anode container has an interior cross-sectional area, at or near a lower end thereof, that is larger than an interior cross-sectional area of an upper end thereof. An anode-receiving container also has a body with a plurality of sides and a lower end having a larger cross-sectional interior area than an upper end. The container may also include punched out apertures positioned to provide strength to the container and an apparatus to vibrate the container coupled to a lower end of the container.

31 Claims, 4 Drawing Sheets

ANODE CONTAINER, ELECTROPLATING SYSTEM, METHOD AND PLATED OBJECT

BACKGROUND OF THE INVENTION

1. Technical Field

The present invention relates generally to mechanisms for electrolytic plating and, more particularly, to an anode container, electroplating system, method and object so plated.

2. Related Art

Electrolytic plating system anode containers often consist of an open mesh type structure or basket that contains anode material, sometimes in the form of spheres, that provide electrical contact between anode material and flow of plating solution through the array of anode material. See, for example, U.S. Pat. Nos. 4,059,493 and 4,569,744 to Rice and Walker, respectively. During the electroplating process, anode materials are consumed over time. These baskets commonly have a limitation, that as the anode material dissolvesand the remaining anode material descends toward the bottom of the basket, a bridge or arch will form, preventing the material from descending further in the basket. When a basket having parallel faces is loaded with a particulate medium, such as spheres, an outward pressure is applied to the faces of the anode container and the container faces deform outwardly. Unfortunately, the anode material does not pass the point of maximum deformation, hence, creating a self-supporting bridge or arch area. If there are holes, braces, or supports in the basket, the chance of a bridge or arch is increased. When a bridge or arch is created, the anode material must be removed or repositioned to disassemble the bridge, hence, slowing the overall processes.

If the bridge or arch is not removed, variations in plating thickness can occur. Since the plating ions take the path of least resistance, i.e., the shortest distance, two mechanisms occur to alter the plating deposit. First, the anode material at or below the bridge or arch in the anode container can be depleted reducing available ions with no replacement material passing the bridge or arch. Secondly, the electrical circuit can be disturbed to the lower portion of the anode container, reducing current flow through the anode material below the bridge or arch. Both of these situations reduce the plating in the same region of the plating cell or object(s) being plated. Since most plating systems are time and current controlled, the plating above the bridge or arch in the anode container is increased to compensate for the reduced plating below the bridge or arch, increasing the overall variability of the plating deposited on the object(s).

Previous anode baskets have used expanded mesh members to provide plating solution flow and ion transport. Sometimes, a sheet of metal, such as titanium, is slit and expanded to create the basket by plastic deformation. Unfortunately, the deformation of the slit sheet of metal creates out-of-plane areas in the side of the basket which catch on the anode material. Where the baskets are created by slitting plastic sheets, the baskets are not as strong. See, for example, U.S. Pat. No. 5,340,456 to Mehler.

One way of promoting anode material motion has been to apply a shock or vibration to the anode basket. See, for example, U.S. Pat. No. 3,862,745 to Chiz and U.K. Patent No. 315,481 to Collingridge. Where the baskets are mesh or contain welded joints, the vibration mechanisms can deform the basket and/or break welded joints within the basket. In the case where vibration is applied to the anode material above a bridge or arch, these additional loads are transmitted by the bridge or arch to the face of the anode container, further deforming the container and breaking weld joints.

In view of the foregoing, there is a need in the art for an electroplating system having a strong anode-receiving container that prevents anode bridging and arching.

SUMMARY OF THE INVENTION

In a first general aspect of the invention is provided an electroplating system comprising: a solution tank filled with electroplating solution; an anode-receiving container having an interior cross-sectional area, at or near a lower end thereof, that is larger than an interior cross-sectional area of an upper end thereof, the anode-receiving container containing anode material and being within the solution tank; and a power supply electrically connected to an object to be plated and the anode-receiving container.

In a second general aspect of the invention is provided an anode-receiving container comprising an interior cross-sectional area, at or near a lower end thereof, that is larger than an interior cross-sectional area of an upper end thereof.

In a third general aspect of the invention is provided an anode container comprising: a body having a plurality of sides and an upper and lower end, wherein the lower end has a larger cross-sectional interior area than the upper end.

In a fourth general aspect of the invention is provided an electroplating process comprising the steps of: supporting an object to be plated in a tank filled with electroplating solution; supporting plating material in the electroplating solution in a container having an interior cross-sectional area, at or near a lower end thereof, that is larger than an interior cross-sectional area of an upper end thereof; and supplying an electric current through the object to be plated, the electroplating solution and the container including the plating material, whereby plating material is plated onto the object. In a fifth aspect of the invention an object plated by the above process is provided.

The anode container, electroplating system, and method in accordance with the invention allow the anode material to move downward into a physically larger region, reducing the chance of an arch or bridge from forming. Further, since all structures deform some amount when a force is applied, a container having an interior cross-sectional area, at or near a lower end thereof, that is larger than an interior cross-sectional area of an upper end thereof, can be formed to exceed deformations that the container may experience and therefore insure that the anode material moves into an expanding region. The plated object in accordance with the present invention therefore is more likely to have uniform plating.

The invention may also include a plurality of punched in apertures in the container wall(s). The punched apertures provide a number of advantages. First, they allow for fluid flow without creating areas which can catch on the anode material and thus prevent downward movement of anode material. Second, the punched apertures allow the container to be made of a fewer sheets of material to reduce the number of welds necessary. Accordingly, the invention may also include an apparatus to vibrate the container to further aid in the prevention of bridging with less worry about breaking mesh or welds. Last, by tailoring the punch size and spacing, various percentages of open areas can be developed such that ribs of solid material can be left as attachment areas for other stiffening members, if necessary.

With regard to the apparatus for vibrating the container, it has been found that application of the forces to the bottom of the container has the advantage of moving the bottom surface under the anodic material that would be supporting the bridge or arch, allowing the material to drop or descend.

The foregoing and other features and advantages of the invention will be apparent from the following more particular description of preferred embodiments of the invention.

BRIEF DESCRIPTION OF THE DRAWINGS

The preferred embodiments of this invention will be described in detail, with reference to the following figures, wherein like designations denote like elements, and wherein.

It should be noted that the drawings are not to scale. They merely depict schematic representations of the invention and, therefore, should not be considered as limiting the scope of the invention.

DESCRIPTION OF THE PREFERRED EMBODIMENTS

Although certain preferred embodiments of the present invention will be shown and described in detail, it should be understood that various changes and modifications may be made without departing from the scope of the appended claims. The scope of the present invention will in no way be limited to the number of constituting components, the material thereof, the shapes thereof, the relative arrangement thereof, etc., and are disclosed simply as an example of the preferred embodiment.

Figure 1A:
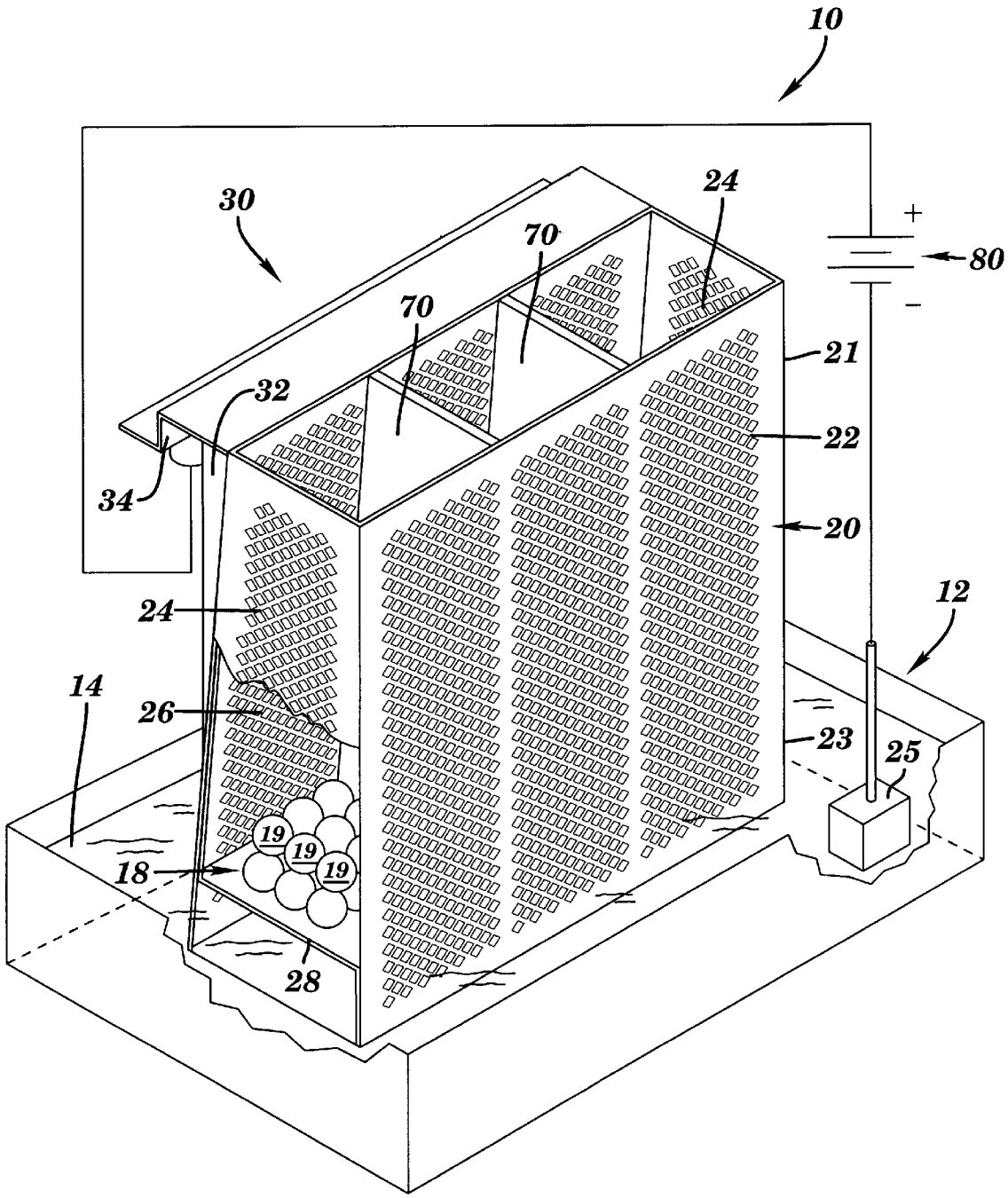
FIG. 1A shows an isometric view of the electroplating system and anode container in accordance with the present invention.

Referring to FIGS. 1A, an electrolytic plating system 10 in accordance with the present invention is illustrated. Electrolytic plating system 10 includes electroplating tank 12 which is filled with electroplating solution 14, typically an aqueous salt solution of a metal to be plated. System 10 also includes an anode basket or container 20 within tank 12. Power supply 80 is also provided and is electrically connected to anode container 20 and object(s) 25 to be plated.

Anode container 20 carries solid metal anode material 18 which is dissolved and deposited upon object(s) 25 to be plated. Solid metal anode material 18, as shown, is commonly in the form of spheres 19 and is made of the material to be plated. Plating material can be, but are not limited to, copper, zinc, cadmium or nickel. Solution 14 comprises ions of the plating material. It should be recognized that anode material 18 may take a variety of shapes. Hence, spheres 19 should not be considered limiting.

Figure 1B:
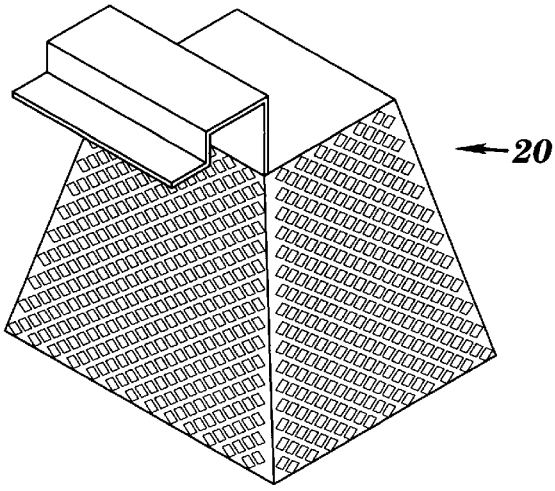
FIG. 1B shows an isometric view of an anode container in accordance with a second embodiment of the present invention.

In a preferred embodiment, anode container 20 includes a body having four outer walls or sides 22, 24, 26. Walls 22, 24, 26 preferably include a plurality of punched out apertures 50, shown in FIG. 2, to allow flow of plating solution 14 therethrough. It is a feature of the present invention that container 20 has upper end 21 having an interior cross-sectional area smaller than an interior cross-sectional area of lower end 23, such that anode material 18 can descend into an increasing cross-sectional area and volume. In other words, container 20 has an increased cross-sectional area and, hence, increased volume below its upper end 21. A preferred way to accommodate this is to have at least one wall 26 of container 20 diverge from another opposing wall 22 from upper end 21 to lower end 23 of container 20. Edges of walls 24 are angled to accommodate this diverging of wall 26 from wall 22. It is important to recognize that while one wall 26 is shown diverging from an opposing wall 22, that any number of walls 22, 24, 26 can diverge from opposing walls. For example, if all four walls diverge, anode container 20 would be in a substantially frusto-pyramidal shape, as shown in FIG. 1B.

Figure 1C:
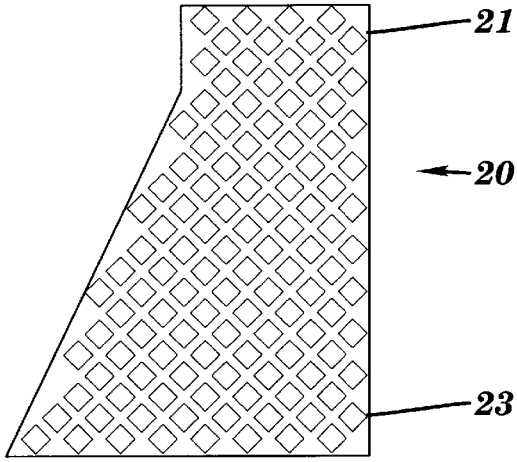
FIG. 1C shows a side view of an anode container in accordance with a third embodiment of the present invention.
Figure 1D:
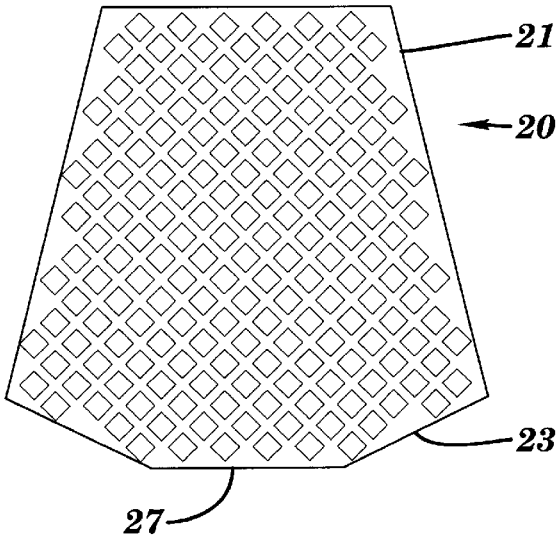
FIG. 1D shows a side view of an anode container in accordance with a fourth embodiment of the present invention.

It should also be recognized that anode container 20 is not limited to a four sided container. For instance, container 20 may be rounded. Furthermore, container 20 does not have to diverge along its entire length. For instance, as shown in FIG. 1C, container 20 may begin to diverge at some point downwardly from upper end 21. Container 20 may also diverge along most of its length to a point near lower end 23 at which it converges such that a lowermost point 27 has a smaller cross-sectional area than upper end 21, as shown in FIG. 1D. Any anode-receiving container that has an interior cross-sectional area, at or near a lower end thereof, that is larger than an interior cross-sectional area of an upper end of the container is considered within the scope of the invention.

Anode container 20 also includes a bottom 28 and a container support 30. Container support 30 includes a body connection portion 32 to attach to container 20, e.g., to wall 26, and a holding portion 34 attached thereto. Holding portion 34 supports container 20 from an external support (not shown) to tank 12. Container support 30 may also advantageously be the connection point for container 20 to power supply 80.

Figure 2:
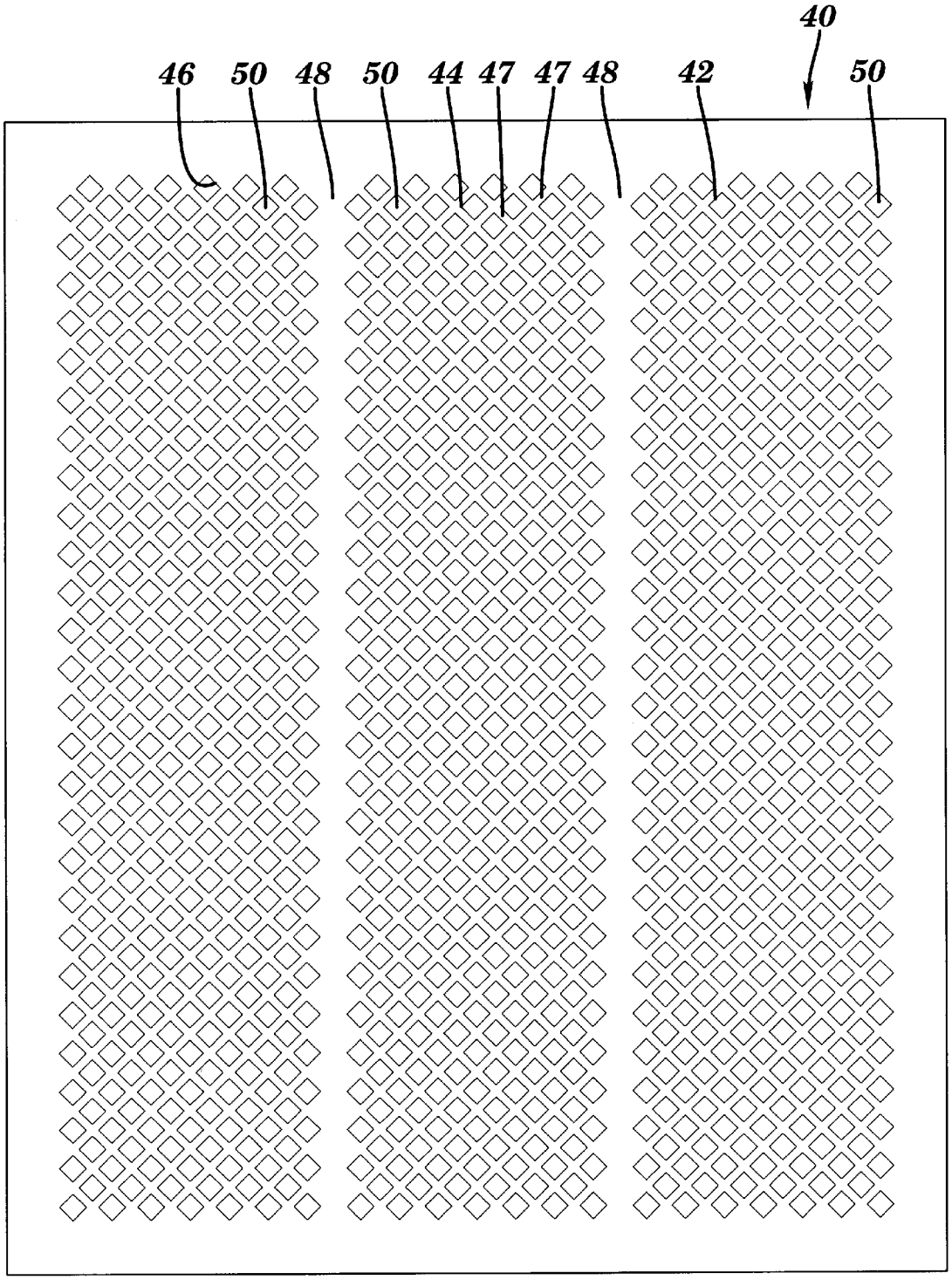
FIG. 2 shows a layout of punched apertures in a sheet of material to be formed into an anode container in accordance with the present invention.

As shown in FIG. 2, wall 22 of container 20 is preferably formed in a single sheet 40 having three sections 42, 44, 46 of apertures 50 and ribs 48 extending vertically therebetween. Ribs 48 provide an area for attachment of optional partitions 70 of container 20, as shown in FIG. 1A, e.g., by welding, etc. Side 22 is attached to side walls 24, and side walls 24 are attached to wall 26, e.g., by welding, etc. Container 20 is preferably made of a good electrically conductive metal that is not soluble in electrolyte solution 14, e.g., titanium. Apertures 50 are preferably punched apertures that are polygonal, preferably square to provide maximum opening size and being able to maintain substantially equal supporting ribs with both a positive and negative slope. Apertures 50 are smaller than anode material 18 and are preferably punched so that any resulting burrs from the punching are on the outside of anode container 20, e.g., the side of sheet 40 upon which the punch first contacts is the inside of anode container 20. In this way, any burrs will be located away from anode material 18, reducing locations where anode material 18 can start a bridge or arch. When apertures 50 are square, they are punched at a 45° angle on each side so as to form ribs or webs 47, as shown in FIG. 2, extending at a 45° angle on sides 22, 24, 26. Other angles are possible depending on the polygonal shape used. Ribs 47 can be used to fasten additional supports (not shown) within container 20, if necessary, and provide strength not exhibited by prior art designs. Bottom 28 of container 20 may be formed as a single piece with wall 26 or may be separately welded to the sides 22, 24, 26.

Punched apertures 50 allow solution flow without creating areas which can catch on anode material 18; allow container 20 to be made of a fewer sheets of material to reduce the number of welds necessary; and, by tailoring the punch size and spacing, allow various percentages of open areas. It should be recognized, however, that container 20 need not include apertures 50 in every side so long as a uniform presentation of solution to object(s) 25 to be plated is provided.

Figure 3:
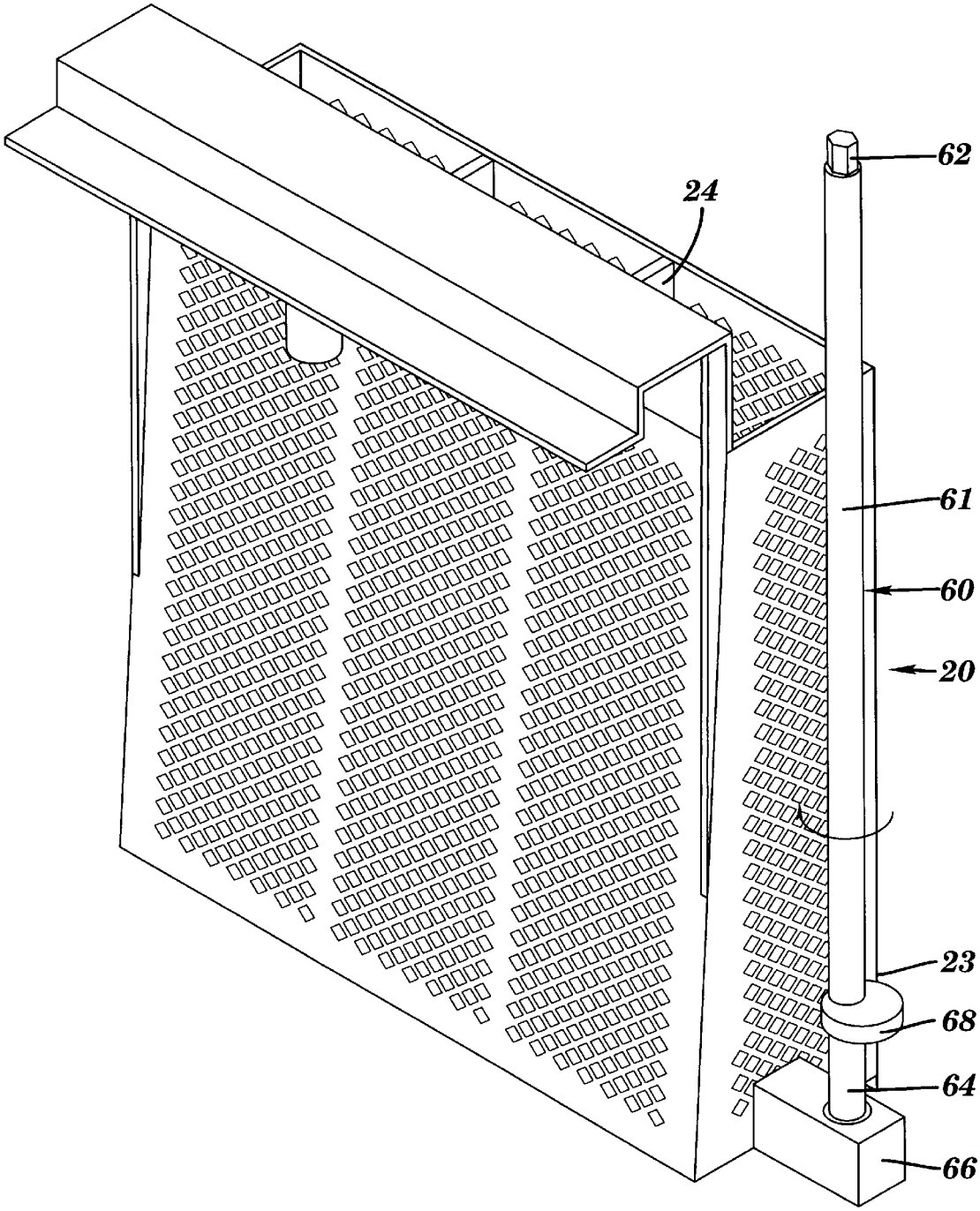
FIG. 3 shows an apparatus for vibrating an anode container in accordance with another embodiment of the present invention.

After taking the preceding precautions against anode material 18 bridging or arching it is still advantageous to provide a means to disrupt a bridge or arch if it develops. The addition of a vibration mechanism can improve plating efficiency by providing a more uniform container loading or packing. Referring to FIG. 3, an apparatus to vibrate 60 container 20 is shown. Apparatus to vibrate 60 includes a rod 61 made of a material not soluble in solution 14, e.g., titanium. Rod 61 has an upper end 62 that is attachable to a source of rotation (not shown) such as an electric motor, drill, etc., and a lower end 64. Lower end 64 is couplable to a bushing 66 attached to lower end 23 of container 20. Rod 61 also includes an eccentric mass 68 which when rotated causes a vibratory motion to be imparted to container 20 via bushing 66. It has been found that application of the forces to lower end 23 of container 10 has the advantage of moving a bottom surface under anode material 18 that would be supporting the bridge or arch, allowing the material to drop or descend. However, it should be recognized that apparatus to vibrate 60 may be located elsewhere on container 20, if desired. Further, apparatus to vibrate 60 may take a variety of forms, not shown. An advantage of having a rod and eccentric mass type vibration mechanism, however, is that the mechanism can be moved from one plating unit to another and is not subjected to aggressive chemical environments of the electroplating system.

In operation, the process in accordance with the invention includes supporting object(s) to be plated 25 in tank 12 filled with electroplating solution 14, supporting plating/anode material 18 in electroplating solution 14 in container 20 having an interior cross-sectional area, at or near lower end 23 thereof, that is larger than an interior cross-sectional area of upper end 21 thereof, and supplying an electric current through object(s) to be plated 25, electroplating solution 14 and container 20 including anode material 18. Anode-receiving container 20 acts as the anode while the object(s) 25 to be plated act as the cathode and attract ions of the plating material, i.e., anode material 18, onto object(s) 25, hence plating object 25 with anode material 18. As the process proceeds, anode material 18 diminishes in size (volume) and descends in container 20. Anode container 20 having a lower end with a larger cross-sectional area than an upper end allows anode material 18 to move into an expanded region, reducing the chance of an arch or bridge from forming. Since all structures deform some amount when a force is applied, a container having an interior cross-sectional area, at or near a lower end thereof, that is larger than an interior cross-sectional area of an upper end thereof can be formed to exceed deformations that the container may experience and therefore insure that the anode material moves into an expanding region.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

We claim:

1. An electroplating system comprising:

a solution tank filled with electroplating solution;

an anode-receiving container having an interior cross-sectional area, at or near a lower end thereof, that is larger than an interior cross-sectional area of an upper end thereof, the anode-receiving container containing anode material and being within the solution tank; and a power supply electrically connected to an object to be plated and the anode-receiving container.

2. The electroplating system of claim 1, wherein the anode- receiving container includes a plurality of walls.

3. The electroplating system of claim 2, wherein one of the plurality of walls diverges downwardly from an opposing wall.

4. The electroplating system of claim 2, wherein the walls include a plurality of apertures therein.

5. The electroplating system of claim 4, wherein the apertures are punched into the walls.

6. The electroplating system of claim 5, wherein the apertures are punched so that they are aligned at a 45° angle.

7. The electroplating system of claim 4, wherein the apertures are polygonal.

8. The electroplating system of claim 7, wherein the apertures are square.

9. The electroplating system of claim 1, further including an apparatus for vibrating the anode-receiving container.

10. The electroplating system of claim 9, wherein the apparatus for vibrating is attached to the lower end of the anode-receiving container.

11. An anode-receiving container comprising an interior cross-sectional area, at or near a lower end thereof, that is larger than an interior cross-sectional area of an upper end thereof.

12. The anode-receiving container of claim 11, wherein the anode-receiving container includes a plurality of sides.

13. The anode-receiving container of claim 12, wherein one of the plurality of sides diverges downwardly from an opposing side.

14. The anode-receiving container of claim 12, wherein the plurality of sides include apertures punched therein.

15. The anode-receiving container of claim 14, wherein the apertures are punched so that they are aligned at a 45° angle.

16. The anode-receiving container of claim 14, wherein the apertures are polygonal.

17. The anode-receiving container of claim 16, wherein the apertures are square.

18. The anode-receiving container of claim 11, further including an apparatus for vibrating the anode-receiving container.

19. The anode-receiving container of claim 18, wherein the apparatus for vibrating is attached to the lower end of the anode-receiving container.

20. An anode container for electroplating comprising:

a body having a plurality of sides and an upper and lower end, wherein the lower end has a larger cross-sectional interior area than the upper end.

21. The anode container of claim 20, wherein the plurality of sides each have a plurality of apertures therein.

22. The anode container of claim 21, wherein the apertures are punched into the sides.

23. The anode container of claim 22, wherein the apertures are punched so that they are aligned at a 45° angle.

24. The anode container of claim 21, wherein the apertures are polygonal.

25. The anode container of claim 24, wherein the apertures are square.

26. The anode container of claim 20, further including an apparatus for vibrating the body.

27. The anode container of claim 26, wherein the apparatus for vibrating is attached to the lower end of the body.

28. An electroplating process comprising the steps of:

supporting an object to be plated in a tank filled with electroplating solution;

supporting plating material in the electroplating solution in a container having an interior cross-sectional area, at or near a lower end thereof, that is larger than an interior cross-sectional area of an upper end thereof; and supplying an electric current through the object to be plated, the electroplating solution and the container including the plating material, whereby plating material is plated onto the object.

29. The electroplating process of claim 28, wherein the container includes a plurality of sides, with one side diverging from an opposing side.

30. The electroplating process of claim 28, further comprising the step of vibrating a lower end of the container.

31. An electroplated object plated using an electroplating process comprising the steps of:

supporting an object to be plated in a tank filled with electroplating solution;

supporting plating material in the electroplating solution in a container having an interior cross-sectional area, at or near a lower end thereof, that is larger than an interior cross-sectional area of an upper end thereof; and supplying an electric current through the object to be plated, the electroplating solution and the container including the plating material, whereby plating material is plated onto the object.

* * * * *